US011680381B2

(12) United States Patent
Albers et al.

(10) Patent No.: US 11,680,381 B2
(45) Date of Patent: Jun. 20, 2023

(54) VARIABLE SYSTEM PRESSURE BASED ON IMPLEMENT POSITION

(71) Applicant: Caterpillar Underground Mining Pty. Ltd., South Bernie (AU)

(72) Inventors: Riley A. Albers, Sugar Grove, IL (US); David R. Evans, Siler City, NC (US); William N. O'Neill, Eureka, IL (US); Jason P. Wigg, Ridgley (AU); Jeffrey K. Berry, Yorkville, IL (US); James T. Ferrier, Cary, IL (US)

(73) Assignee: Caterpillar Underground Mining Pty. Ltd., Tasmania (AU)

( * ) Notice: Subject to any disclaimer, the term of this patent is extended or adjusted under 35 U.S.C. 154(b) by 178 days.

(21) Appl. No.: 17/248,070

(22) Filed: Jan. 7, 2021

(65) Prior Publication Data

US 2022/0213664 A1 Jul. 7, 2022

(51) Int. Cl.

| | |
|---|---|
| ***E02F 3/42*** | (2006.01) |
| ***E02F 9/22*** | (2006.01) |
| ***E02F 3/28*** | (2006.01) |
| ***E02F 9/20*** | (2006.01) |
| ***F15B 15/20*** | (2006.01) |
| ***E02F 3/43*** | (2006.01) |

(52) U.S. Cl.

CPC ..... *E02F 3/422* (2013.01); *E02F 3/283* (2013.01); *E02F 3/431* (2013.01); *E02F 9/2033* (2013.01); *E02F 9/2228* (2013.01); *F15B 15/20* (2013.01); *E02F 9/2267* (2013.01); *E02F 9/2296* (2013.01)

(58) Field of Classification Search

CPC ..... E02F 9/2296; E02F 9/2228; F15B 11/165; F15B 2211/20546; F15B 2211/6055; F15B 2211/6336

See application file for complete search history.

(56) References Cited

U.S. PATENT DOCUMENTS

| | | | | |
|---|---|---|---|---|
| 5,085,051 | A | 2/1992 | Hirata | |
| 5,469,646 | A | 11/1995 | Takamura | |
| 8,281,583 | B2 * | 10/2012 | Kauss | F15B 11/166 60/452 |
| 8,660,758 | B2 | 2/2014 | Janardhan et al. | |
| 8,756,930 | B2 | 6/2014 | Johnson et al. | |
| 9,080,311 | B2 | 7/2015 | Yoshida et al. | |
| 9,976,283 | B2 | 5/2018 | Tsuruga et al. | |
| 10,030,678 | B2 * | 7/2018 | Stahle | F15B 13/026 |
| 10,060,451 | B2 * | 8/2018 | Takahashi | E02F 9/2296 |

(Continued)

FOREIGN PATENT DOCUMENTS

| | | |
|---|---|---|
| CN | 201203599 | 3/2009 |
| CN | 101285808 | 8/2010 |

(Continued)

*Primary Examiner* — Thomas E Lazo

(57) ABSTRACT

A hydraulic system for controlling an implement on a work machine may include a hydraulic reservoir, a hydraulic pump in fluid communication with the reservoir, a central valve in fluid communication with the pump and configured for controlling the implement, a load sense pressure relief system, and a controller. The controller may be configured for controlling the central valve and the load sense pressure relief system and selecting between operating the hydraulic system at a first pressure and a second pressure based on a factor relating to implement position.

9 Claims, 10 Drawing Sheets

(56) References Cited

U.S. PATENT DOCUMENTS

| | | | | |
|---|---|---|---|---|
| 10,100,495 | B2 * | 10/2018 | Takahashi | F15B 13/024 |
| 10,107,311 | B2 | 10/2018 | Takahashi et al. | |
| 10,215,198 | B2 | 2/2019 | Takahashi et al. | |
| 11,052,881 | B1 * | 7/2021 | Chen | B60T 10/04 |
| 2018/0202468 | A1 * | 7/2018 | Tracy | B66F 9/22 |

FOREIGN PATENT DOCUMENTS

| | | | | |
|---|---|---|---|---|
| CN | 201983989 | | 9/2011 | |
| CN | 102175517 | | 10/2012 | |
| WO | WO-03087585 | A1 * | 10/2003 | F15B 11/165 |

* cited by examiner

VARIABLE SYSTEM PRESSURE BASED ON IMPLEMENT POSITION

TECHNICAL FIELD

The present application relates generally to hydraulic systems such as those used on work machines including heavy equipment for construction, farm implements, and other machines adapted for performing work, More particularly, the present application relates to a variable system pressure in a hydraulic system for work machines. Still more particularly, the present application relates to a variable system pressure in a mining work machine allowing for variable payload machines to have same or similar linkage systems while avoiding undue wear and/or overloading conditions.

BACKGROUND

Commonality between components of work machines can create advantages for design and development, manufacturing, and resulting cost. However, user desired variability relating to size, speed, and function of the work machines has a tendency to cause or generate differences in work machines rather than commonalities. In the mining industry, various constraints on size can place limits on varying the size of work machines. That is, for example, in the case of underground loaders, constraints on height, width, turning radii, and other constraints may cause machine size to be limited and, in some circumstances, may tend toward forced commonality of physical components. This type of forced commonality can lead to other problems. For example, one solution may be to place larger hydraulic cylinders on machines designed for use with smaller hydraulic cylinders. This can result in overloading of particular components of the machine causing failure or premature failure. In addition, particular functions of the machine may have excessive power and, as a result, components related to that function may wear out prematurely due a lack of restrictions on use, for example. On the other hand, the machine could be designed to withstand the loads of larger hydraulic cylinders or higher pressures, but this may result in mass increases for the structure, which can decrease the performance of the machine.

U.S. Pat. No. 5,085,051 to Hirata discloses a load-sensing control responsive to a differential pressure. Hirata also discloses an instruction device that instructs a change in the differential pressure. U.S. Pat. No. 5,469,646 discloses an excavator adapted to be changed over simply to a fine operation mode so as to control the capacity of a hydraulic pump through load-sensing.

SUMMARY

In one or more embodiments, a hydraulic system for controlling an implement on a work machine may include a hydraulic reservoir, a hydraulic pump in fluid communication with the reservoir, a central valve in fluid communication with the pump and configured for controlling the implement, a load sense pressure relief system and a controller. The controller may be configured for controlling the central valve and the load sense pressure relief system and selecting between operating the hydraulic system at a first pressure and a second pressure based on a factor relating to implement position.

In one or more embodiments, a method of operating a hydraulic system, may include operating a work machine and controlling an implement of the work machine with a hydraulic system. The method may also include monitoring a factor relating to implement position, operating the hydraulic system at a first of a plurality of available system pressures unless and until the implement position dictates switching to a second of the plurality of available system pressures. The method may also include switching to the second pressure and operating the hydraulic system at the second pressure unless and until the implement position dictates switching back to the first pressure.

In one or more embodiments, a work machine may include an implement and a hydraulic system for controlling the implement. The hydraulic system may include a hydraulic reservoir, a hydraulic pump in fluid communication with the reservoir, a central valve in fluid communication with the pump and configured for controlling the implement, a load sense pressure relief system; and a controller. The controller may be configured for controlling the central valve and the load sense pressure relief system and selecting between operating the hydraulic system at a first pressure and a second pressure based on a factor relating to implement position.

DETAILED DESCRIPTION

Figure 1:
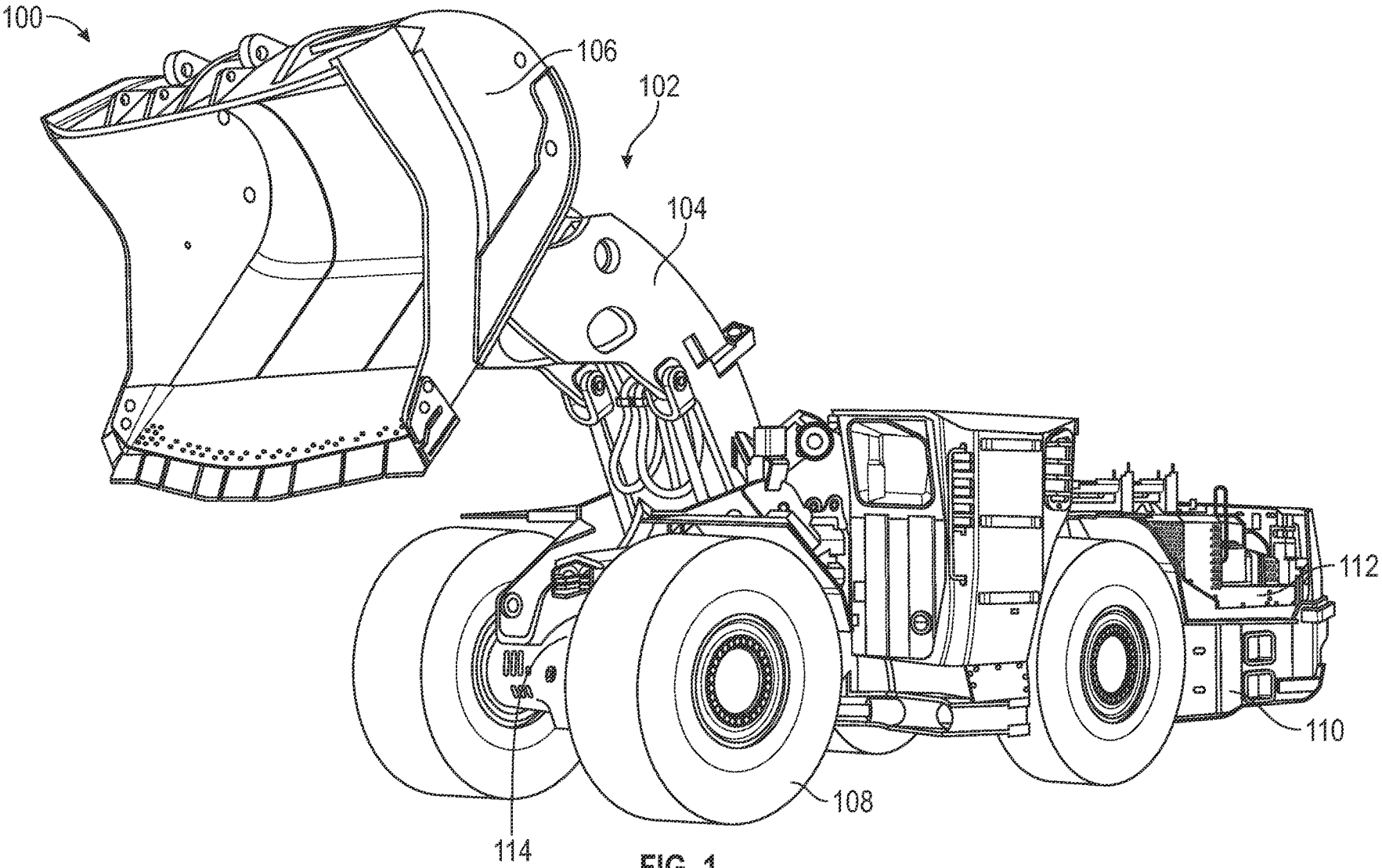
FIG. 1 is a front left perspective view of a work machine having a hydraulic system with a variable system pressure and having a raised bucket in a tipped position, according to one or more embodiments.

FIG. 1 is a perspective view of a work machine 100. As shown, the work machine 100 may be an underground loader used in mining operations and may include an implement 102 in the form of lift arms 104 and a tilting bucket 106. That is, the lift arms 104 may be arranged and configured to lift the tilting bucket 106 and the tilting bucket 106 may be arranged and configured on the lift arms 104 to tilt relative to the lift arms 104. The implement system may be moveable using a hydraulic system. The work machine may include a plurality of ground supporting traction elements 108 (e.g., wheels, tracks, skid feet, etc.) for translating the work machine relative to a supporting surface. The traction elements 108 may be coupled to a frame 110 of the work machine 100 with a suspension system. The work machine 100 may include an engine or motor 112 to generate power and to drive the traction system 108, the hydraulic system, and other onboard equipment or systems.

Figure 2:
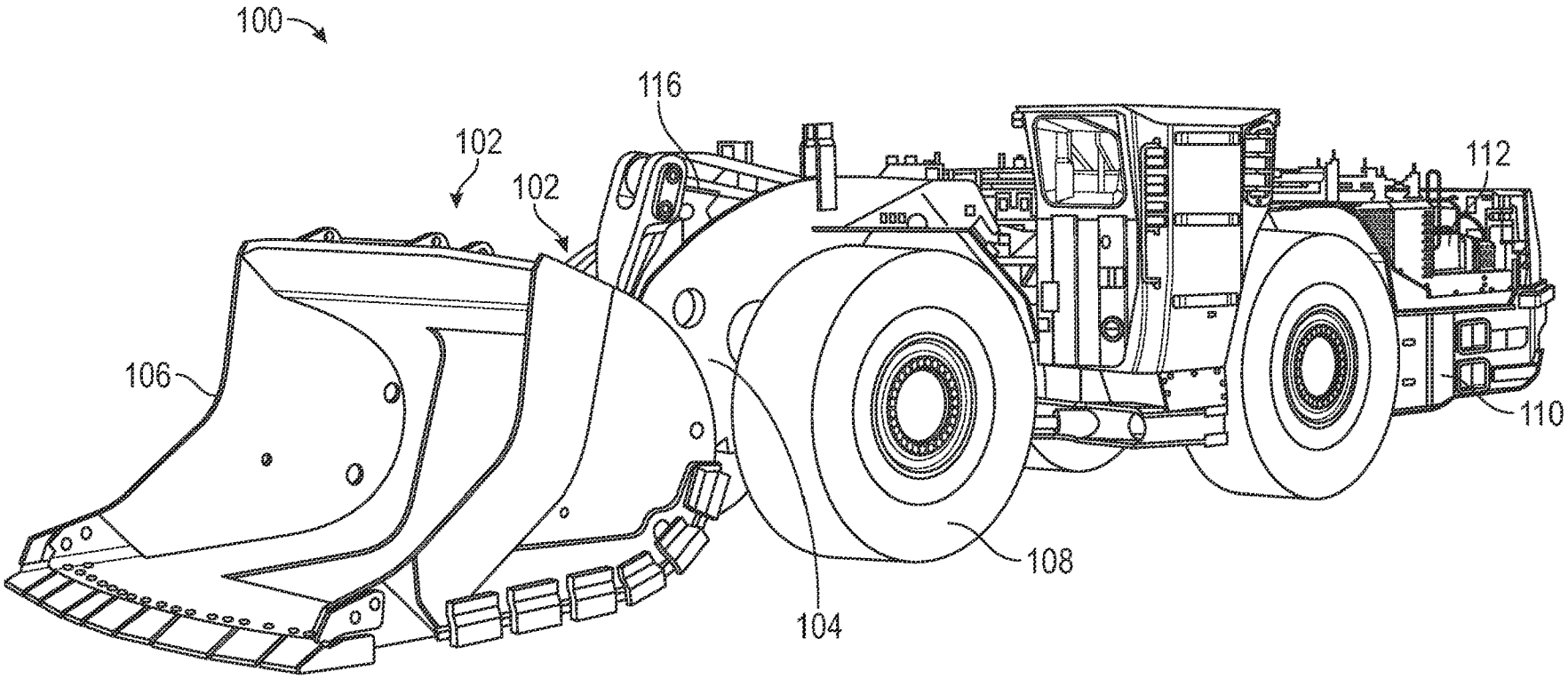
FIG. 2 is a front left perspective view of the work machine of FIG. 1, with a lowered bucket in dig or scoop position, according to one or more embodiments.
Figure 3:
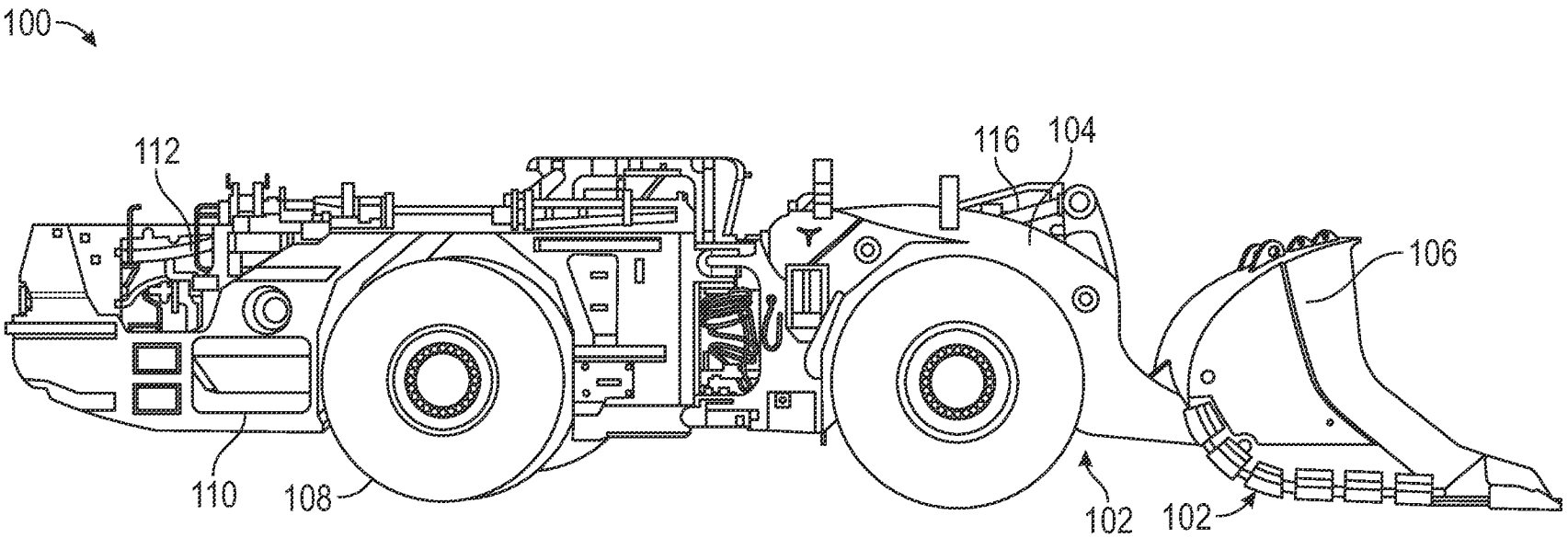
FIG. 3 is right side view thereof.

In FIG. 1, the lift arms 104 are shown in a raised position and revealing a lift arm hydraulic system 114 including a pair of hydraulic cylinders for raising and lowering the lift arms 104. FIG. 2 is a perspective view of the work machine with the lift arms 104 in a lowered position and revealing a bucket hydraulic system 116 including a central hydraulic cylinder for controlling the tilt position of the bucket 106, FIG. 3 is a side view of the work machine 100.

Figure 4:
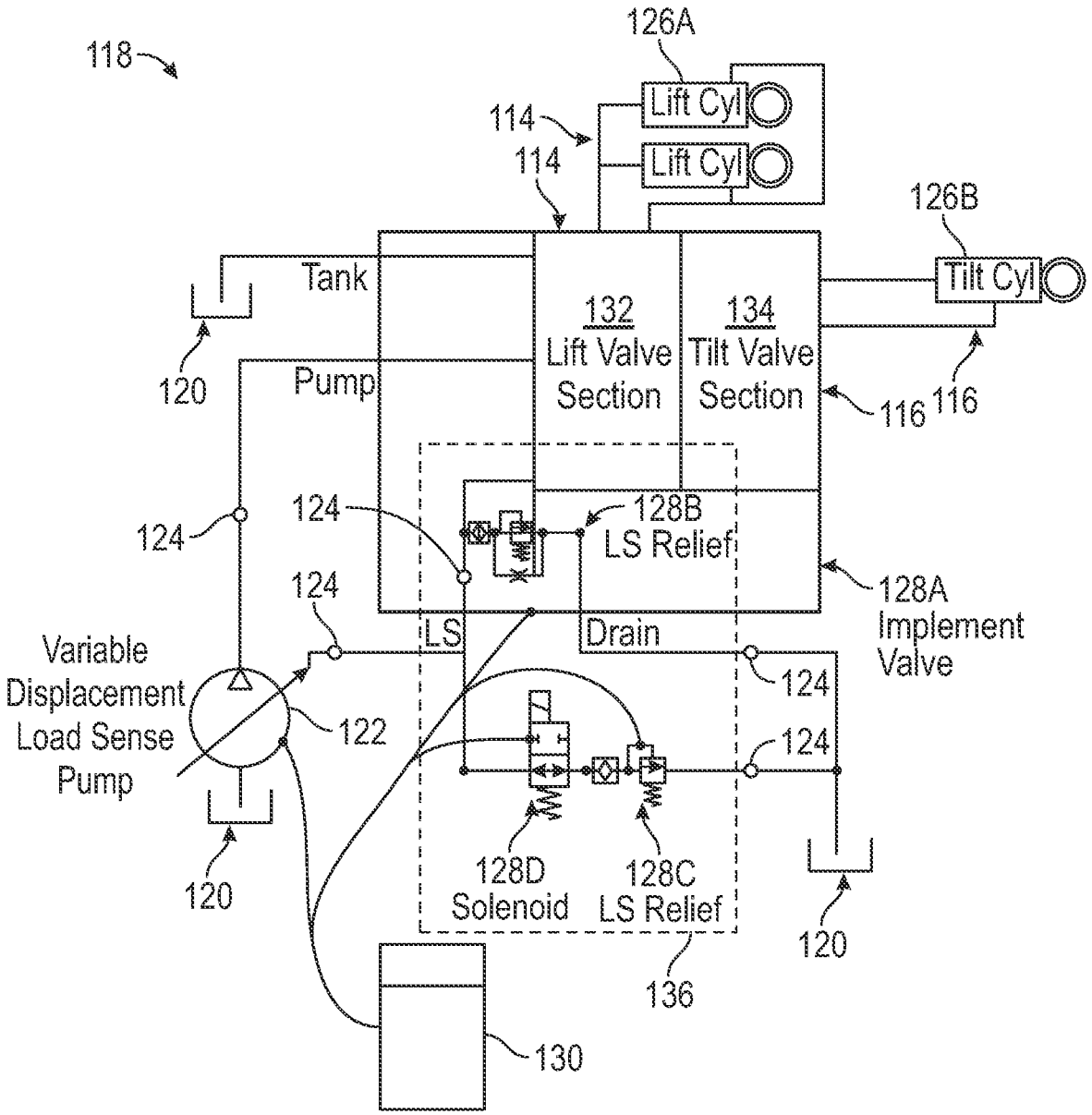
FIG. 4 is a hydraulic schematic of the hydraulic system providing for variable system pressure, according to one or more embodiments.

Referring now to FIG. 4, a schematic drawing of the hydraulic system 118 is provided. The present hydraulic system may be configured for varying the maximum or available hydraulic system pressure based on one or more factors. In one or more embodiments, the factors may include implement position such as height, orientation, position, amount of travel, or other positional data points, for example. As mentioned, the work machine 100 may include a lift arm hydraulic system 114 and a bucket hydraulic system 116. These systems may share one or more components and may be part of the same system 118 operating on a same hydraulic pressure. As shown, the hydraulic system 118 may include a shared hydraulic reservoir 120, a shared hydraulic pump 122, a series of hydraulic lines 124, one or more hydraulic cylinders 126A/B, one or more valves or solenoids 128A/B/C/D, and a control system 130 for controlling the pump, the valves, the solenoids, and/or other aspects of the system. It is to be appreciated that while a shared reservoir and pump system is shown, other systems may include dedicated reservoirs or pumps.

The hydraulic reservoir 120 may be configured for holding a supply of hydraulic fluid for use by the system. The hydraulic reservoir 120 may include a holding tank, for example. The tank may be generally closed to prevent intrusion of contaminants, but may include valves or other ports allowing the tank to be maintained at or near atmospheric pressure or another baseline pressure. The holding tank may contain a supply of hydraulic fluid that may be drawn from the holding tank by a hydraulic pump 122 and delivered to a pressurized portion of the system. Various relief valves and/or return lines may deliver the hydraulic fluid back to the holding tank in particular conditions or circumstances.

The hydraulic pump 122 may be arranged in fluid communication with the hydraulic reservoir 120 and may operate to draw fluid from the hydraulic reservoir 120, pressurize the fluid and deliver it to the operative side of the system. For example, the pump 122 may pressurize the fluid to extend one or more hydraulic cylinders. The pump may be sized to deliver a selected range of pressures suitable for the particular system being provided. In one or more embodiments, the pump may include a variable displacement load sense pump.

The hydraulic lines 124 may extend from the pump to the hydraulic cylinders 126A/B and or from the pump to one or more valves 128A/B/C/D and from the valves to the hydraulic cylinders 126A/B. The hydraulic lines 124 may include pressure resisting lines capable of maintaining the hydraulic fluid at pressures created by the pump and delivering the hydraulic fluid.

The hydraulic cylinders 126A/B may be configured for performing work by extending and/or retracting. The hydraulic cylinders 126A/B may include a housing, a piston arranged within the housing and a rod coupled to the piston and extending out an end of the housing. The housing may include one or more ports for receiving and/or ejecting hydraulic fluid to fill or remove fluid from the housing on one or more sides of the piston causing the piston to articulate back and forth within the housing to extend or retract the piston rod. In the present case of an underground loader, the system may include a pair of lift arm cylinders for raising and lowering the lift arms and a single tilt cylinder for tilting the bucket.

The system may also include one or more valves 128A/B/C/D. As shown in FIG. 4, the system may include a central implement valve 128A. In the present case, for example on an underground loader, the implement valve 128A may include a lift valve section 132 and a tilt valve section 134. The lift valve section 134 may control the hydraulic fluid, and the pressures thereof, that operate the lift arm hydraulic cylinders 126A. The tilt valve section 134 may control the hydraulic fluid, and the pressures thereof, that operate the tilt cylinder 126B.

The hydraulic system 118 may, as in the present example, have a variable displacement load sensing pump 122 that is controlled by the load sense signal circuit. When a control valve 132 or 134 is opened to provide flow to the load, or cylinders 126A/B in this system, the load sense system may be supplied with pressure created by the work being done. The variable displacement load sensing pump 122 may provide sufficient flow for the pump discharge flow to maintain a margin over the load sense pressure unless the pump reaches maximum displacement without achieving this margin pressure. Margin may be a pressure somewhat greater than the load sense signal, for example. If the valve section 132 and 134 are not activated, the pump 122 will only supply enough flow to maintain the margin pressure and account for internal leakages in the system. In this embodiment maximum load sense pressure may be limited by the pressure relief system 136. The amount of flow allowed into the load sense circuit may be a limited and very small percentage of the available pump flow. This may allow the pressure relief system to limit the pressure in the load sense circuit.

Additional valves in the present system may be provided and configured for varying the maximum hydraulic system pressure based on one or more factors as mentioned. That is, as shown, the hydraulic system may include a load sense pressure relief system 136 arranged between the hydraulic pump 122 and the lift valve section 132 and the tilt valve section 134 of the central implement valve 128A. That is, the load sense pressure relief system 136 may be arranged to control pump 122 and the valve sections and may be arranged between the pump 122 and the cylinders 126A/B. The load sense pressure relief system 136 may include a first load sense relief valve 128B, such as a high pressure load sense relief valve, and a second load sense relief valve 128C, such as a low pressure load sense relief valve. The relief valves 128B/C may be configured to limit system pressures. For example, the relief valves may have a pressure setting, such as a threshold pressure. The load sense relief valves 128B/C may remain closed unless or until the pressure in the system exceeds the threshold pressures. Upon reaching the threshold pressure of either relief valve, that respective relief valve may open allowing hydraulic fluid from the load sense circuit system to exit the circuit and return to the tank 120. The relief of hydraulic fluid from the load sense circuit may provide for maintaining the hydraulic system at the threshold pressure without exceeding the threshold pressure.

The load sense pressure relief system 136 may include a pair of branches off of the hydraulic line connecting the pump 122 with the implement valve 128A. The pair of branches may include a low pressure branch and a high pressure branch. The low pressure branch may include the low pressure relief valve 128C and the high pressure branch may include the high pressure relief valve 128B. The low and high pressure branches may be arranged in parallel and lead back to the hydraulic reservoir 120. This arrangement may allow the system to operate at a system pressure dictated by whichever valve is open. For example, the system pressure may be limited to the threshold pressure of the low pressure relief valve and may not reach the threshold pressure of the high pressure relief valve. However, as shown, the system may also include a solenoid 128D for varying the effect of the pressure relief valves on the system.

As shown in FIG. 4, the low pressure branch of the load sense pressure relief system may include a solenoid valve 128D arranged on the pump side of the low pressure relief valve 128C. The solenoid valve 128D may be an electrically actuated solenoid valve that is open in a non-energized condition and is closed in an energized condition. As such, the solenoid 128D may be used to cut off flow of hydraulic fluid to the low pressure load sense relief valve 128C. Cutting off the flow of hydraulic fluid to the low pressure load sense relief valve may cause the system to function as if the low pressure sense relief valve is not present. As such, when the solenoid valve 128D is closed, the system pressure may rise above the threshold pressure of the low pressure load sense relief valve and the system press e may be dictated by the threshold pressure of the high pressure load sense relief valve 128B.

It is to be appreciated that while a system having a first low pressure load sense relief valve and a second high pressure load sense relief valve has been described, a system with a first high pressure load sense relief valve and a second low pressure sense relief valve may be provided. Moreover, while a system with two pressure sense relief valves has been described, additional load sense relief valves may be provided to allow for multiple system pressures including 2, 3, 4, or more system pressures based on one or more conditions. Still further, a system with a variable load sense relief valve may also be provided such that the available system pressures may be adjusted. For example, a controllable coil may be provided to allow the load sense relief setting to be varied and/or controlled periodically or continuously.

It is also to be appreciated that while a particular plumbing arrangement has been described, other plumbing arrangements may be provided that may provide a similar effect. For example, a two branch parallel load sense relief system may be provided where the branches are selectable by a valve, thereby allowing the hydraulic fluid flow to be directed passed a selected pressure sense relief valve. Still other hydraulic plumbing arrangements may be provided to establish the effect of selecting between multiple system pressures.

Further review of FIG. 4 shows that the high pressure load sense relief valve 128B is shown within the boundary identified as the implement valve 128A. That is, in one or more embodiments, the high pressure sense relief valve 128B may be a component of the central valve 128A and the solenoid valve 128D and the low pressure sense relief valve 128C may be supplemental components that are provided to augment the implement valve 128A and provide for multiple operation pressures.

The system may also include a control system 130. The control system 130 may be configured to control the implement valve 128A allowing the lift cylinders 126A and the tilt cylinder 126B to be controlled to operate the implement of the work machine 100. That is, for example, opening the lift valve section 132 of the implement valve 128A may deliver hydraulic fluid to the lift cylinders 126A causing them to extend or to retract depending on the direction of the delivery of fluid. Similarly, opening the tilt valve section 134 of the implement valve 128A may deliver hydraulic fluid to the tilt cylinder 126B causing it to extend or retract depending on the direction of the delivery of fluid. Still further, based on one more factors, the control system 130 may be configured to operate the solenoid 128D to close the solenoid 128D and adjust the system pressure.

The control system 130 may be a standalone control system for the hydraulic system or the control system may be part and parcel with the control system for the work machine 100. In either case, the control system may include a computing device having a processor and a computer readable storage medium. The computer readable storage medium may include computer implemented instructions stored thereon including method steps for controlling the equipment based on user input. That is, the work machine 100 may include one or more interfaces for controlling the equipment including, for example, joysticks, touch screens, levers, buttons, switches, throttles, etc. The control system 130 may be in electrical communication with the mentioned interfaces and may also be in electrical communication and/or signal communication with one or more aspects of the hydraulic system 118 such as the pump 122, the implement valve 128A, the solenoid 128D and/or other aspects of the hydraulic system 118.

Figure 5:
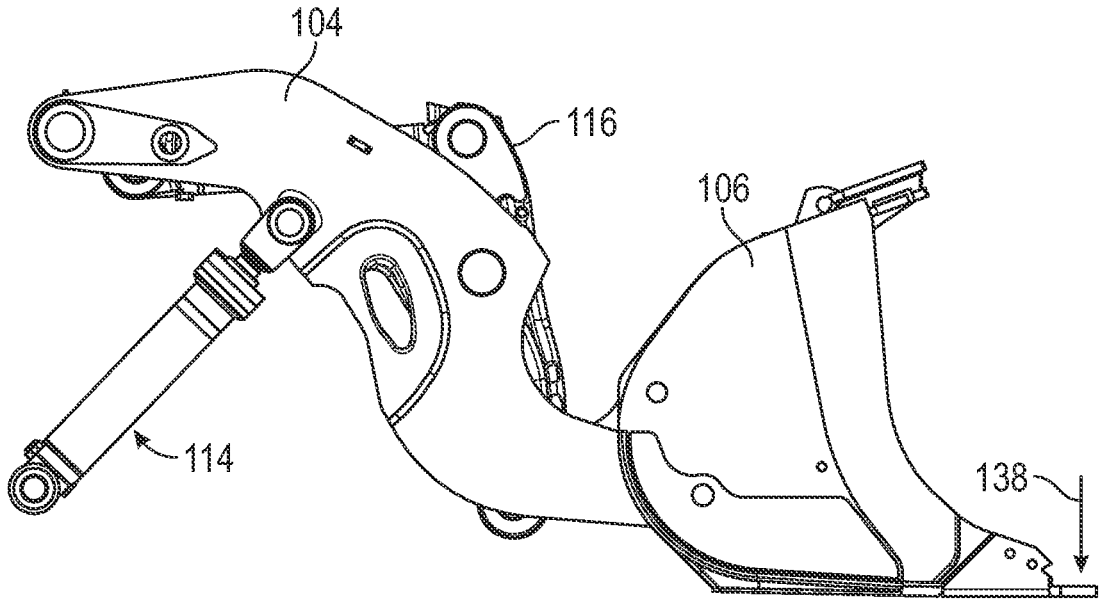
FIG. 5 is right side view of the implement portion of the work machine of FIGS. 1-3 showing the lift arms and bucket in a dig or scoop position, according to one or more embodiments.
Figure 6:
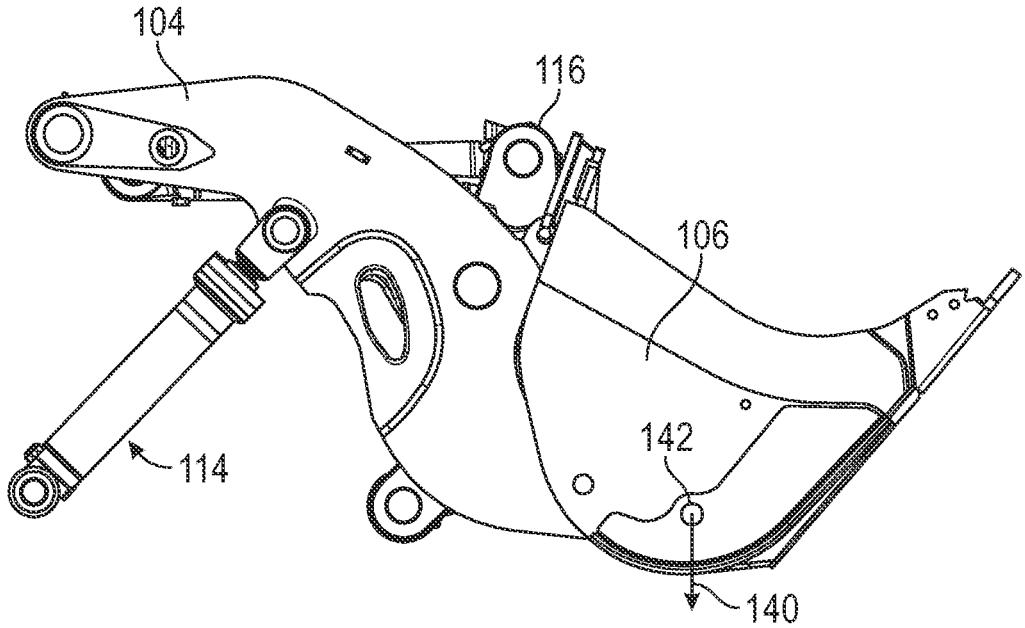
FIG. 6 is a right side view of the implement portion of the work machine of FIGS. 1-3 showing the lift arms and bucket in a poised to lift position, according to one or more embodiments.
Figure 7:
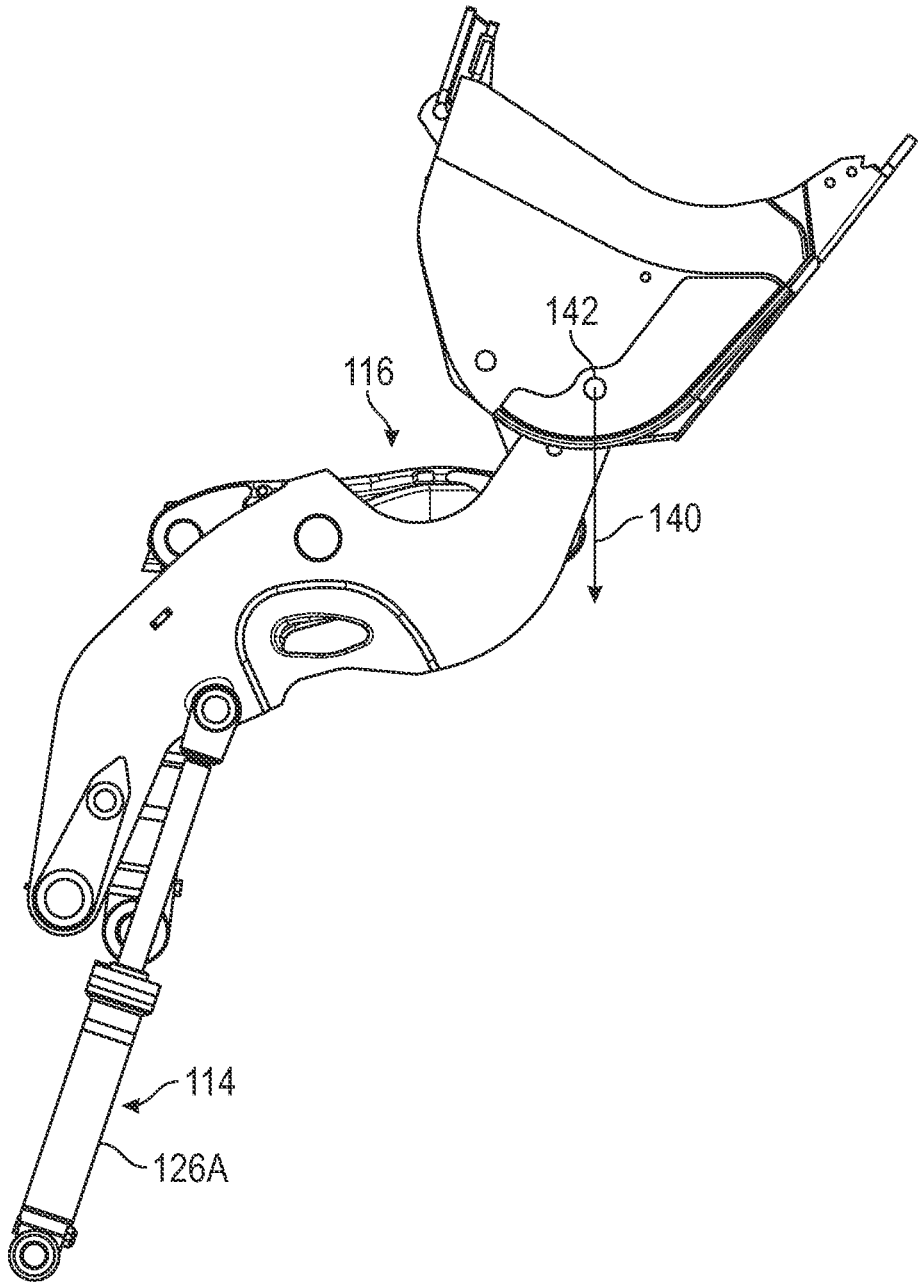
FIG. 7 is a right side view of the implement portion of the work machine of FIGS. 1-3 showing the lift arms and bucket in a lifted position, according to one or more embodiments.

Turning now to FIGS. 5-7, a series of example loading conditions on the lift arms 104 of a work machine 100 are shown. As shown in FIG. 5, a breakout load 138 is shown. The load represents the force between the tip of the bucket and the material being lifted by the bucket. For example, when a loader is digging into a pile of dirt, rock, rubble, or other material, the force of the material on the bucket when lifting the collected material from a pile is reflected by the break out load 138. It is to be appreciated that the actual load may be a varying distributed load throughout the depth of the bucket, but for purposes of the present explanation, a point load is depicted. This particular breakout load 138 may reflect a design criteria load and may be used in the design of the lift arm 104 and the bucket 106. In particular, the breakout load 138 may be relevant for arranging the pin points of the overall linkage including the lift arms 104, the bucket 106, and the hydraulic cylinder connection points. In one or more embodiments, the breakout load may be targeted to a particular value such that hydraulic power available to the system does not overly affect the durability of the system, but is sufficient to achieve suitable or even optimized digging capabilities.

In addition to breakout load 138, payload of the bucket may also be used as a design criteria for linkage and hydraulic system design. The payload may include the amount of material the bucket is capable of carrying. The payload may act on the bucket through the center of gravity of the material in bucket.

FIG. 6 shows a force 140 acting at the bucket pin where the bucket is pinned to the lift arms. That is, forces on the bucket may be depicted by a force 140 acting on the lift arms at the pinned pivot point 142 of the bucket. For example, the breakout force 138 may be modeled as a load 140 on the pin with the lift arm and bucket in a digging position. As shown in FIG. 7, the maximum payload may be modeled as a load 140 on the pin when the lift arms 104 are raised to their highest height where the lift arm hydraulic cylinders 126A are extended to their fullest length. The payload acting on the system in this position may reflect an additional design criteria condition for the system. For example, given a particular arrangement of the pin points of the overall linkage, the system may be designed to be able to carry a particular payload in the condition shown.

Figure 8:
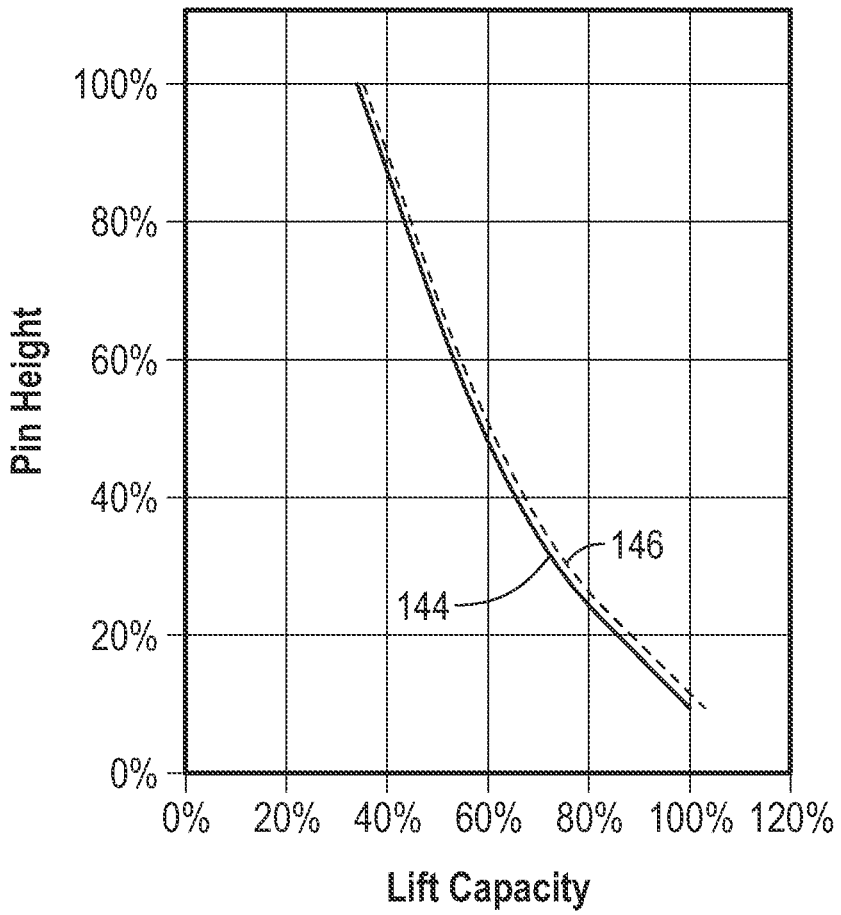
FIG. 8 is a graph showing lift height of the bucket pin relative to lift arm capacity for two different payload machines, according to one or more embodiments.
Figure 9:
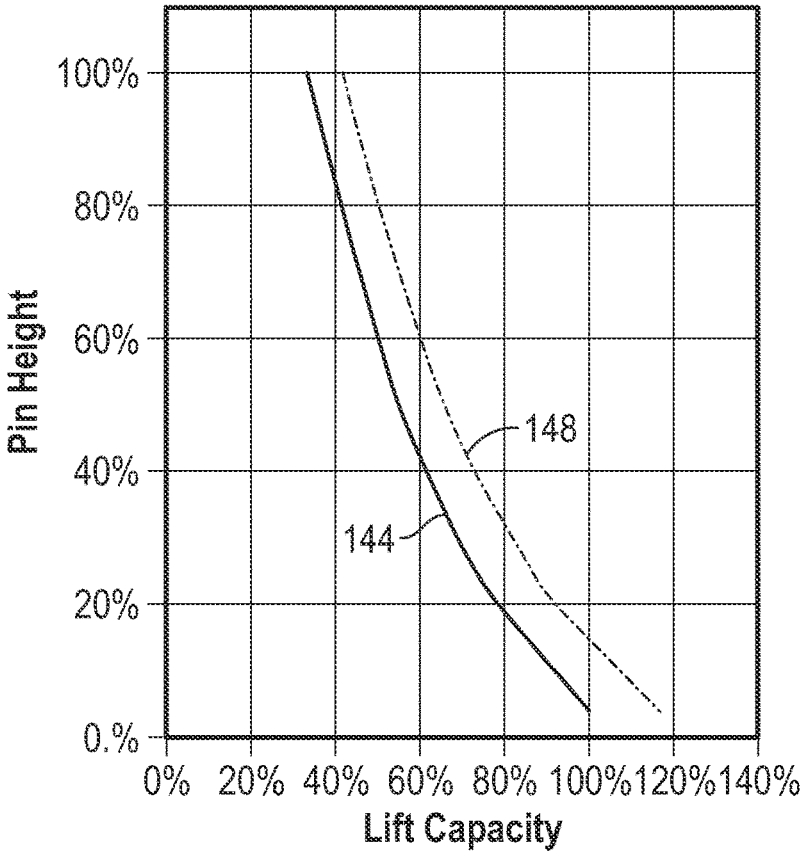
FIG. 9 is a graph showing lift height of the bucket pin relative to lift arm capacity for two different payload machines, according to one or more embodiments.

As discussed above, commonality between work machines of varying capacities can be advantageous for purposes of design, manufacturing, and resulting equipment cost. Accordingly, it may be desirable to maintain linkage arrangements between work machines having varying load capacities. However, merely adjusting the hydraulic power (e.g., changing the cylinder size or cylinder pressure) of the machine may create opportunities for excessive loading, fatigue, or wear of particular components on higher capacity machines. For example, design criteria may call for limiting the breakout load 138 to avoid excessive loading or wear and manage durability of the equipment. The graphs in FIGS. 8 and 9 depict the difficulties associated with maintaining a single linkage system and adjusting the capacity based on hydraulic power (e.g., changing the cylinder size or cylinder pressure). Both of these figures relate the percentage of lift capacity of the linkage of the work machine 100 to percentage of pin height where the pin height is the height of the pivot pin 142 connecting the bucket 106 to the lift arms 104. As such, the breakout force 138 shown in FIG. 5, but modeled as a pin load 140 may define the bottom end of the curves and the payload force at max lift shown in FIG. 7, but also modeled as a pin load 140 may define the upper end of the curves.

In FIG. 8, the solid line 144 reflects a baseline machine with an acceptable breakout force (e.g., ~100% of lift capacity) and an acceptable payload force (~38% of lift capacity). The dashed line reflects a machine having a slightly higher hydraulic power, but with a power limited such that the breakout force 138 does not exceed durability limits of the equipment (e.g., the pin load 140 at the bottom end of curve has only slightly more lift capacity than the baseline). As shown, limiting the hydraulic power to control the breakout force 138 transcends the curve 146 of the higher capacity machine and results in a limit on the higher capacity machine's payload at max lift (e.g., the pin load 140 at the top end of curve is only slightly higher than the baseline). Accordingly, the design durability limitation prevents leveraging the potential additional hydraulic power.

In FIG. 9, the design durability limitation is ignored and a higher hydraulic power is provided to achieve the desired higher payload at max lift. As shown, the solid line 144, again, reflects a baseline machine with an acceptable breakout force and an acceptable payload force. The dashed and dotted line 148 reflects a machine having a higher hydraulic power sufficient to achieve a desired payload at max lift. As can be seen from the graph, the higher payload machine may have a payload at max lift that is approximately 10% higher than the baseline machine. (e.g., pin load 140 at the top end of curve shows about 10% more lift capacity than baseline) However, and likewise, the breakout force (e.g., pin load 140 at the bottom end of curve) also exceeds the breakout force of the baseline machine and, as such, may exceed the design durability limitation for breakout force.

Figure 10A:
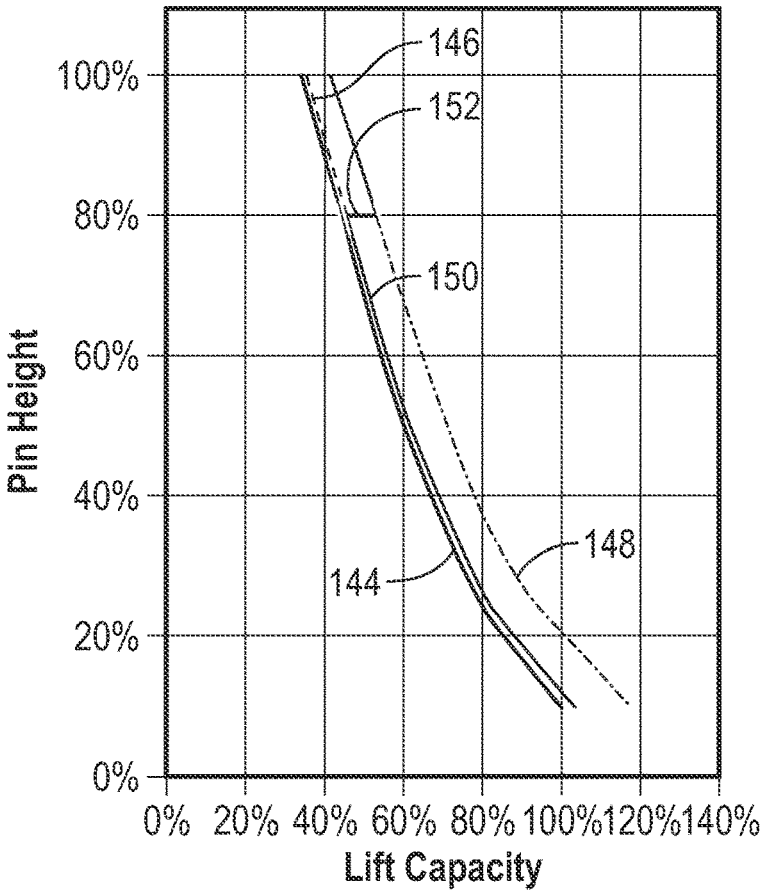
FIG. 10A is a graph showing lift height of the bucket pin relative to lift arm capacity for a machine having a varying system pressure, according to one or more embodiments.

The presently described hydraulic system may allow for commonality of linkage designs, while also meeting the design durability limitations on the breakout force. As shown in FIG. 10A, the several lines (e.g., solid 144, dashed 146, and dashed and dotted 148) from FIGS. 8 and 9 are included on a single graph. In addition, an operation curve 150 is overlayed on these lines. As shown, the load sense pressure relief valves may be utilized to control the available hydraulic system pressure such that a selected curve may be followed based on one or more factors. For example, a higher capacity machine may include a higher powered hydraulic pump to deliver higher pressures or larger hydraulic cylinders may be provided when compared to the baseline machine reflected by the solid line 144. However, the low pressure load sense relief valve may be sized and selected to control the available hydraulic system pressure and approximate or only slightly exceed the baseline curve (e.g., the dashed line 146 slightly exceeds solid line 144). Based on one or more factors, the solenoid may be closed to remove the effect of the low pressure sense relief valve and, thus, allow the system to operate at a higher pressure based on the high pressure sense relief valve (e.g., the dashed and dotted line 148). As shown in FIG. 10A, the operation curve 150 may follow the baseline curve 144 or the curve 146 that only slightly exceeds the baseline curve. The operation curve 150 may continue to follow this lower curve as the pin height is increased until the operation curve reaches a transition point 152. At the transition point 152, the operation curve 150 may shift laterally to the higher power curve 148 and may follow the higher power curve to the higher pin heights. As shown, the system may, thus, control the available pressure at lower pin heights and, as such, control the breakout force. However, at higher pin heights, the system may adjust the to a higher available pressure and, as such, provide for a higher payload.

Figure 10B:
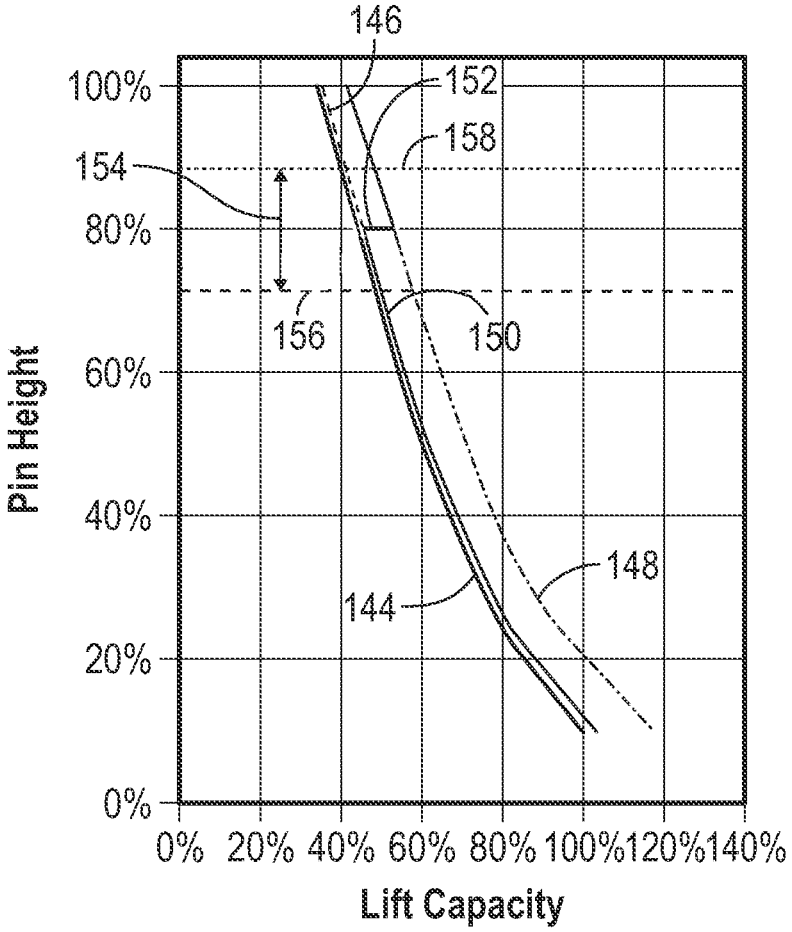
FIG. 10B is a graph showing lift height of the bucket pin relative to lift arm capacity for a machine having a varying system pressure and including upper and lower limits, according to one or more embodiments.

Referring now to FIG. 10B, a graph that is the same or similar to the graph of FIG. 10A is shown. However, FIG. 10B includes horizontal lines that define a transition range 154. For example, a bottom limit line 156 may be provided at or around a pin height of approximately 70% to 78% or approximately 71% to 75% or approximately 73% of an available pin height. In addition, a top limit line 158 may be provided at or around a pin height of approximately 80% to 95% or approximately 85% to 90% or approximately 87% of an available pin height. These range limits may be set to different values depending on the application and the needs of the design. These two lines may define a range 154 within which it is suitable, appropriate, or otherwise desirable to cause the transition between a lower system pressure and a higher system pressure. In the case of an underground loader, or other loaders for that matter, the bottom limit line 156 may be selected to avoid allowing use of the higher pressure in a digging situation. As such, the bottom limit line 156 may be selected to include pin heights that are above a height where an operator may dig with the machine. In this way, excessive breakout force may be avoided and yet, a higher payload at or near the max lift height may be provided.

Figure 10C:
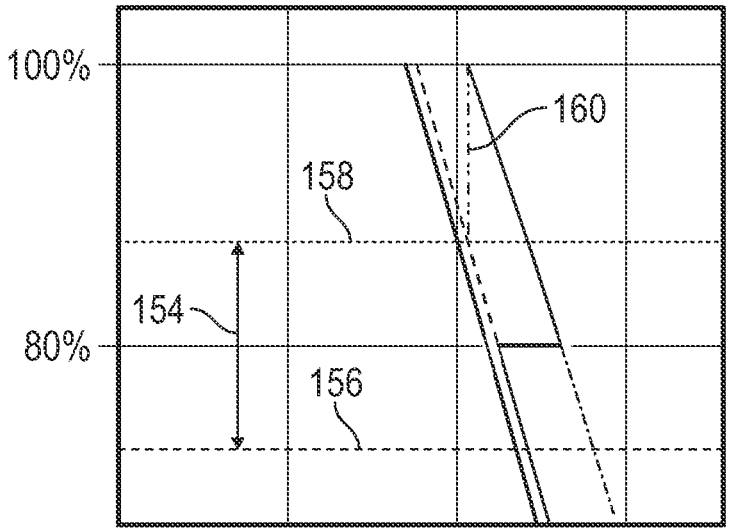
FIG. 10C is a graph showing close up view of FIG. 10B and depicting the relationship between a top limit and the varying system pressure curves, according to one or more embodiments.
Figure 11:
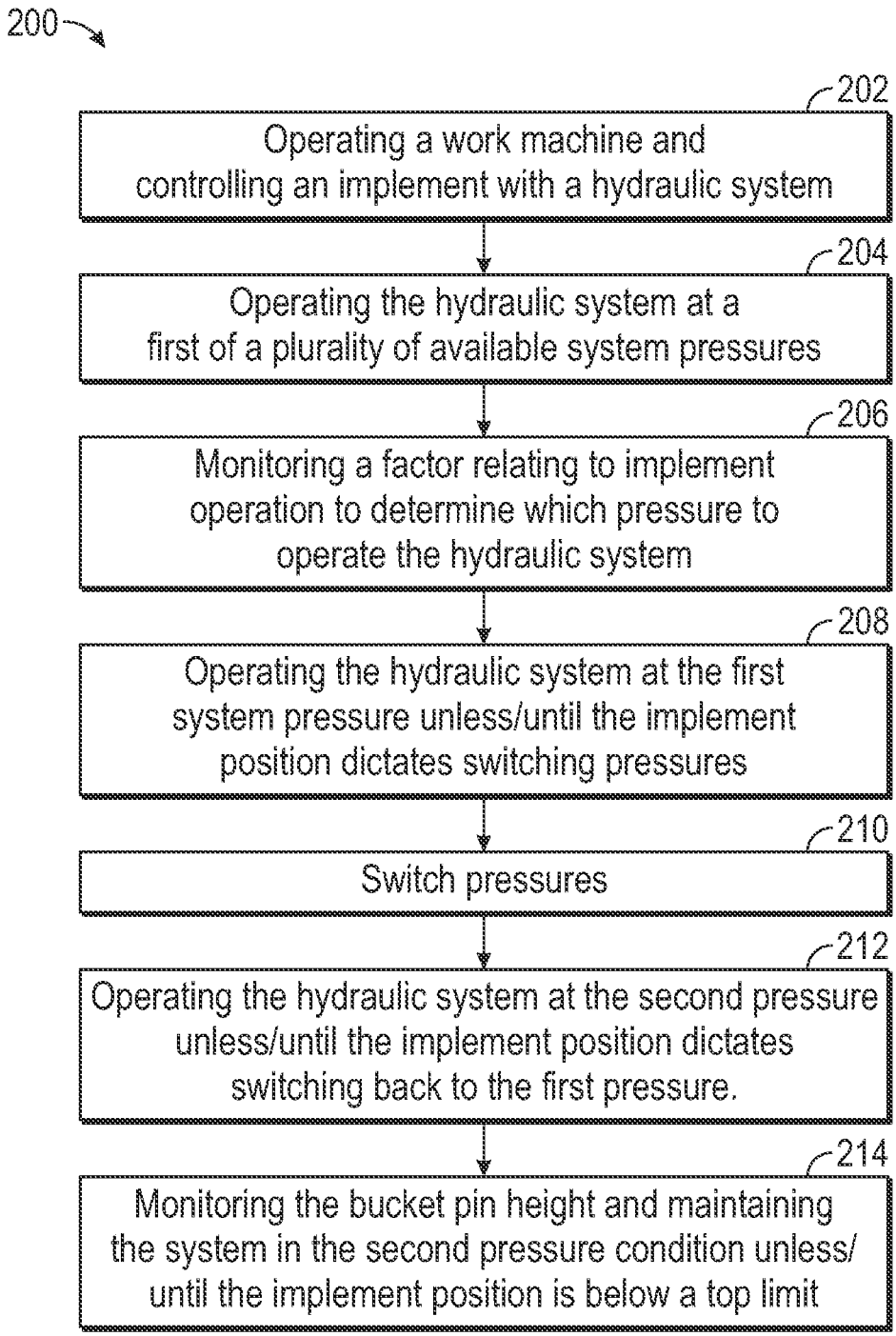
FIG. 11 is a method diagram depicting a method of operation using a variable system pressure based on implement position.

The top limit line 158 may be determined by the low pressure load sense. That is, where the maximum lift capacity of the higher pressure curve intersects with the lower pressure curve as shown by the vertical line 160 in FIG. 10C, the top limit is defined. This limit may help to avoid jolting.

While a work machine 100 in the form of an underground loader has been shown, work machines of all types may utilize the presently described hydraulic system having variable system pressure based on implement position. For example, wheel loaders, skid steers, farm equipment with one or more implements, trench digging equipment, and still other machines that perform work using an implement may include a hydraulic system as described herein.

Still further, it is to be appreciated that using a pin height for controlling the transition shown from a lower pressure curve to a higher pressure curve may be advantageous in the context of a loader because of the issues associated with breakout force and payload at maximum lift height. That is, the relationship between the problem areas is tied to pin height. In other contexts and with other machines and implements, problems associated with higher and lower pressure curves may be related to other factors and transitions between high pressure and lower pressure may be selected to depend on factors other than pin height. For example, a boom and stick on an excavator may have limits associated with a pin distance from the machine. That is, where the pin of the bucket is far from the machine, the lifting heavy payloads may be harder on the linkage and/or may affect machine stability. In this circumstance, limiting the machine hydraulic pressure and, thus, limiting the lift capacity of the implement at longer distances may be desirable. Still other implements and other positional and/or orientational conditions may be used to transition between one or more pressures in a hydraulic system.

INDUSTRIAL APPLICABILITY

In operation and use, the present hydraulic system having a variable system pressure based on implement position may provide for commonality of design between work machines having varying capacities, such as payload capacity. In one or more embodiments, a method (200) of operation of such a machine may be provided. For example, the method may include operating a work machine and controlling an implement with a hydraulic system. (202) The method may also include operating the hydraulic system at a first of one or more available pressures. (204) The method may also include monitoring a factor relating to implement operation to determine which pressure to operate the hydraulic system. (206) In one or more embodiments, the factor may include a threshold bucket pin height, lift arm angle, or another measure of the distance of the bucket above the ground. In particular, the method may include operating the hydraulic system at the first (in some cases a low) system pressure unless/until the implement position dictates switching pressures. (208) That is, for example, when the bucket pin height exceeds a bottom limit defined by a threshold height above which an operator will dig with the work machine, the hydraulic pressure may be increased. When the bucket pin height exceeds the threshold height, a control system may actuate a solenoid to close the solenoid. Closing the solenoid may close off flow of hydraulic fluid to a low pressure load sense relief valve and, as such, may allow the system pressure to increase up to a higher pressure defined by a high pressure load sense relief valve. That is, the method may include switching pressures to a second or other pressure when the implement position dictates such. (210) The method may also include operating the hydraulic system at the second (in some cases high) pressure unless/until the implement position, such as the bucket pin height, dictates switching back to the first pressure such as when the bucket pin height falls below the threshold height. (212) Still further, the method may include monitoring the implement position or bucket pin height and maintaining the solenoid in the closed condition unless/until the implement position or bucket pin height is below a top limit defined by an intersection between the maximum lift capacity under the second pressure and that same lift capacity under the first pressure so as to avoid jolting. (214)

The above detailed description is intended to be illustrative, and not restrictive. The scope of the disclosure should, therefore, be determined with references to the appended claims, along with the full scope of equivalents to which such claims are entitled.

What is claimed is:

1. A hydraulic system for controlling an implement on a work machine, comprising:
- a hydraulic reservoir;
- a hydraulic pump in fluid communication with the reservoir;
- a central valve in fluid communication with the pump and configured for controlling the implement;
- a pressure relief system; and
- a controller configured for controlling the central valve and the pressure relief system and selecting between operating the hydraulic system at a first system pressure and a second system pressure based on a position of the implement, wherein:
  - the position of the implement comprises a threshold height, and
  - wherein the implement is a loader lift arm and bucket system wherein a bucket is pivotably coupled to a lift arm at a pivot pin and the controller compares a height of the pivot pin to the threshold height.

2. The system of claim 1, wherein the threshold height comprises a bottom limit and a top limit.

3. The system of claim 2, wherein the bottom limit is selected to require the pivot pin to be above a reasonable dig height for the bucket.

4. The system of claim 3, wherein the top limit is selected to require the pivot pin to be below a height where a lower pressure of the first and second system pressures is insufficient to maintain the bucket with a maximum payload.

5. A method of operating a hydraulic system, the method comprising:
- operating a work machine and controlling an implement of the work machine with a hydraulic system;
- monitoring a factor relating to implement position;
- operating the hydraulic system at a first of a plurality of available system pressures unless and until the implement position dictates switching to a second of the plurality of available system pressures;
- switching to the second pressure;
- operating the hydraulic system at the second pressure unless and until the implement position dictates switching back to the first pressure, wherein the factor relating to implement position is a pin height of a bucket on a loader.

6. The method of claim 5, wherein monitoring a factor relating to implement position comprises comparing the pin height to a bottom limit and a top limit.

7. The method of claim 6, wherein the bottom limit is a height above which it is no longer reasonable to dig.

8. The method of claim 7, wherein the top limit is a height below which the first pressure is sufficient to carry the maximum payload.

9. A work machine comprising:

an implement;

a hydraulic system for controlling the implement, comprising:

a hydraulic reservoir;

a hydraulic pump in fluid communication with the reservoir;

a central valve in fluid communication with the pump and configured for controlling the implement;

a pressure relief system; and a controller configured for controlling the central valve and the pressure relief system and selecting between operating the hydraulic system at a first pressure and a second pressure based on a position of the implement, wherein the work machine comprises a loader and the implement is a lift arm and bucket system.

* * * * *